US006875127B2

(12) United States Patent
Hasegawa

(10) Patent No.: US 6,875,127 B2
(45) **Date of Patent: *Apr. 5, 2005**

(54) GOLF CLUB SHAFT

(75) Inventor: Hiroshi Hasegawa, Hyogo (JP)

(73) Assignee: Sumitomo Rubber Industries, Ltd., Kobe (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 10/192,561

(22) Filed: Jul. 11, 2002

(65) Prior Publication Data

US 2003/0022728 A1 Jan. 30, 2003

(30) Foreign Application Priority Data

Jul. 11, 2001 (JP) ..... 2001-210692

(51) Int. Cl.[7] ..... A63B 53/10
(52) U.S. Cl. ..... 473/319
(58) Field of Search ..... 473/319, 316–318, 473/320

(56) References Cited

U.S. PATENT DOCUMENTS 5,156,396 A 10/1992 Akatsuka et al.
5,437,450 A * 8/1995 Akatsuka et al. ..... 473/320
5,721,030 A * 2/1998 Okada ..... 428/36.3
6,273,830 B1 * 8/2001 Takemura et al. ..... 473/319
6,306,047 B1 10/2001 Kusumoto
2001/0007836 A1 * 7/2001 Atsumi et al. ..... 473/319

FOREIGN PATENT DOCUMENTS

| | | | |
|---|---|---|---|
| JP | 59-20181 | | 2/1984 |
| JP | 5-49718 | | 3/1993 |
| JP | 10-230030 | * | 9/1998 |
| JP | 11-70197 | | 3/1999 |
| JP | 2001-46564 | * | 2/2001 |

* cited by examiner

*Primary Examiner*—Stephen Blau
(74) *Attorney, Agent, or Firm*—Birch, Stewart, Kolasch & Birch, LLP

(57) ABSTRACT

In a golf club shaft, composed of a laminate of prepregs made of a fiber reinforced resin, the weight of a unit length of the golf club shaft in the axial direction thereof is set to not less than 0.25 g/cm nor more than 0.60 g/cm. Supposing that reinforcing fibers of the prepregs of a straight layer are parallel with the axial direction of the golf club shaft and that tensile moduli of elasticity of the reinforcing fibers are sequentially denoted by N1, N2, . . . Nn in the order from an innermost layer of the laminate to an outermost layer thereof, N1≧N2≧ . . . Nn and N1>Nn (n is an integer not less than 2) is established in a range at least 10% of the whole length of the golf club shaft.

20 Claims, 4 Drawing Sheets

GOLF CLUB SHAFT

BACKGROUND OF THE INVENTION

1. Field to the Invention

The present invention relates to a golf club shaft and more particularly to a golf club shaft, made of a fiber reinforced resin, which has an improved strength without increasing its weight.

2. Description of the Related Art

In the case where a prepreg in which fibers are impregnated with a resin is used as the material of the golf club shaft, it is possible to wind on a mandrel a so-called straight layer whose reinforcing fibers are parallel with the axis of the golf club shaft and an angular layer having reinforcing fibers at a certain angle with respect to the axis of the golf club shaft.

In recent years, as the head of a golf club becomes larger and its shaft becomes longer, the shaft is becoming lighter. Thus the shaft is becoming thinner. In this situation, in order to allow the shaft to have a desired rigidity and strength, the shaft is provided with a so-called thin multi-layer construction in which each prepreg layer is thin and the number of turns of prepregs is increased and a construction in which a reinforcing layer is partly provided.

However, the thin multi-layer construction is insufficient for preventing reduction in the strength of the lightweight shaft and causes the rigidity of the shaft to change. Therefore the thin multi-layer construction does not allow the shaft to have a target property value. Further since thin prepregs are used, a larger number of prepregs is wound on a mandrel. Thus a long prepreg-winding time is required, which leads to a workability and which causes air to penetrate into the space between adjacent prepregs easily. Consequently there is a possibility that the performance of the shaft such as its strength and the like is adversely affected thereby. Therefore various proposals are made to improve the strength and the like of the lightweight shaft made of the fiber reinforced resin.

In Japanese Patent Application Laid-Open No.59-20181, there is disclosed a golf club shaft made of fiber reinforced resin in which to eliminate variations of a player's feeling, the bending modulus of elasticity of the outermost layer and that of the inner layer in contact with the outermost layer are specified.

In Japanese Patent Application Laid-Open No.5-49718, a golf club made of carbon fiber reinforced resin is disclosed to obtain a golf club lightweight and highly rigid. The golf club has the inner layer, the outer layer, and the reinforcing layer. In the golf club, the weight a unit length of the shaft, the rigidity thereof, and the twist angle thereof are specified. More specifically, the inner-side prepreg is more elastic than the outer-side prepreg, and the construction of dividing the outer layer into two layers (inner portion and outer portion) is proposed.

However, in the golf club shaft disclosed in Japanese Patent Application Laid-Open No.59-20181, only the bending modulus of elasticity of the outermost layer and that of the inner layer in contact with the outermost layer are specified. Thus in the case where a multi-layer construction which is the normal layering construction is adopted, the strength of the golf club shaft is adversely affected in dependence on the tensile modulus of elasticity of an intermediate layer and the golf club shaft does not twist smoothly. Thus a player has a bad feeling.

In the golf club disclosed in Japanese Patent Application Laid-Open No.5-49718, the relationship between the magnitude of the tensile moduli of elasticity of the adjacent layers and the strength thereof is not specified. Thus in the case where the prepreg having a higher tensile modulus of elasticity than that of the outer layer is used in the inner portion of the outer layer, the strength of the golf club shaft may be insufficient.

SUMMARY OF THE INVENTION

The present invention has been made in view of the above-described problems. Therefore it is an object of the present invention to provide a golf club shaft, made of a fiber reinforced resin, which has an improved strength without increasing its weight and allows a player to have a favorable feeling in hitting a golf ball.

To achieve the object, according to the present invention, there is provided a golf club shaft, composed of a laminate of prepregs made of a fiber reinforced resin, wherein a weight of a unit length of the golf club shaft in an axial direction thereof is set to not less than 0.25 g/cm nor more than 0.60 g/cm. Supposing that tensile moduli of elasticity of the reinforcing fibers of the prepregs of a straight layer, which are parallel with the axial direction of the golf club shaft, are sequentially denoted by N1, N2, . . . Nn in the order from an innermost layer of the laminate to an outermost layer thereof, $N1 \geqq N2 \geqq \ldots \geqq Nn$ and $N1 > Nn$ (n is an integer not less than 2) is established in a range at least 10% of a whole length of the golf club shaft.

As a result experiments the present inventors have made by changing layering order of the prepregs, they found out that as shown in the above equations, in the straight layer which affects the bending strength of the shaft greatly, it is possible to improve the bending strength and durability of the shaft and player's feeling by setting the tensile modulus of elasticity of the reinforcing fiber of the outer prepreg layer of the straight layer smaller than that of the reinforcing fiber of the inner prepreg layer thereof. More specifically, when the shaft is bent, the outer-layer prepreg has a higher displacement and a higher bending strain than the inner-layer prepreg. Thus it is possible to reduce a strain from occurring between layers and improve the strength of the shaft by layering the prepregs, each having a low tensile modulus of elasticity, which is elastic and has a high strength one upon another as the outer layers. By setting the tensile moduli of elasticity of the reinforcing fibers of the straight layer as described above, a player can feel a toe-down, a smooth twist in a swinging direction, and has a good feeling in hitting a golf ball. Thus a golf club composed of the shaft of the present invention allows the player to obtain a good feeling during the use thereof.

The construction of the shaft of the present invention improves the strength of the shaft. Thus the shaft of the present invention is effectively applicable to a lightweight shaft which is thin and has an insufficient strength. Thus it is possible to make the shaft more lightweight.

The shaft is composed of the straight layer whose reinforcing fibers are parallel with the axial direction thereof and the angular layer whose reinforcing fibers are oblique to the axial direction thereof. The angular layer is greatly related to the torque of the shaft. Thus it is necessary to use the prepreg having a low tensile modulus of elasticity when the shaft torque is to be increased. Therefore in the present invention, as described above, in the straight layer, the prepregs are layered one upon another in such a way that the tensile moduli of elasticity of the reinforcing fibers become gradually smaller from the inner layer thereof to the outer layer thereof. In the case where the front end and rear end of the shaft are reinforced, the outer layer prepreg of the straight layer has a lower elastic modulus than the inner layer prepreg. In the case where the mandrel is wound with a plurality of turns of the same prepreg, the prepreg having same tensile modulus of elasticity is disposed on the inner layer and the outer layer. The prepreg having same tensile modulus of elasticity may be layered on each other. However, to allow the effect of the present invention to be displayed efficiently, it is preferable that the tensile moduli of elasticity of the reinforcing fibers of the prepregs of the straight layer are different from one another.

The weight of the shaft per unit length in its axial direction is set to not less than 0.25 g/cm nor more than 0.60 g/cm and favorably not less than 0.30 g/cm nor more than 0.50 g/cm.

If the weight of the shaft is less than 0.25 g/cm, the difference between strengths of layers is slight owing to a small difference between the tensile moduli of elasticity of the layers. On the other hand, if the weight of the shaft is more than 0.60 g/cm, even though there is a difference between the tensile moduli of elasticity of the layers, the shaft is incapable of having a necessary minimum strength.

Supposing that reinforcing fibers of the prepregs of a straight layer are parallel with the axial direction of the golf club shaft and that tensile moduli of elasticity of the reinforcing fibers are sequentially denoted by N1, N2, . . . Nn in the order from an innermost layer of the laminate to an outermost layer thereof, $N1 \geqq N \geqq \ldots Nn$ and $N1 > Nn$ (n is an integer not less than 2) is established in a range at least 10% and favorably at least 25% and more favorably not less than 50% nor more than 100% of the whole length of the golf club shaft. In the case where the condition of the tensile modulus of elasticity is satisfied in the range 10% of the whole length of the shaft, the bending strength of the shaft can be improved. It is particularly preferable that the condition of the tensile modulus of elasticity is satisfied in the range from the head-mounting end of the shaft toward a portion apart by 10% from the head-mounting end.

The difference between the tensile moduli of elasticity of the reinforcing fibers of the adjacent prepregs is set to not less than 2000 kgf/mm$^2$ nor more than 30000 kgf/mm$^2$ and favorably not less than 5000 kgf/mm$^2$ nor more than 16000 kgf/mm$^2$.

If the difference is less than 2000 kgf/mm$^2$, the difference in the tensile moduli of elasticity is too small. In this case, the effect of the present invention cannot be displayed efficiently. On the other hand, if the difference is more than 30000 kgf/mm$^2$, elongations and rigidities of the adjacent layers are different from each other and thus a displacement between the adjacent layers is great when a bending stress is applied to the shaft. Consequently a ply separation is apt to occur, which may cause the strength of the shaft to deteriorate.

In the straight layer, the tensile modulus of elasticity of the reinforcing fiber of an outermost prepreg is not less than 5000 kgf/mm$^2$ nor more than 30000 kgf/mm$^2$ and favorably not less than 5000 kgf/mm$^2$ nor more than 25000 kgf/mm$^2$ and more favorably not less than 5000 kgf/mm$^2$ nor more than 15000 kgf/mm$^2$.

If the tensile modulus of elasticity of the outermost layer is smaller than 5000 kgf/mm$^2$, the shaft is incapable of obtaining a sufficient rigidity value. On the other hand, if the tensile modulus of elasticity of the outermost layer is larger than 30000 kgf/mm$^2$, it is necessary to increase the tensile modulus of elasticity of the inner prepreg layer. In this case, it is difficult for the shaft to obtain an appropriate rigidity. If the shaft has many prepregs each having a high tensile modulus of elasticity, the shaft has a low strength and is incapable of withstanding a great strain.

The golf club shaft has 3–8 straight layers of which said tensile moduli of elasticity of said reinforcing fibers are different from each other. Favorably the golf club shaft has 3–5 straight layers of that. If the reinforcing fibers take less than three tensile moduli of elasticity, the effect of the present invention cannot be displayed efficiently. On the other hand, if the reinforcing fibers take more than eight tensile moduli of elasticity, the number of prepregs to be layered increases. Hence low operability and productivity.

In the golf club shaft of the present invention, the total number of the prepreg layers is set to not less than three nor more than 12 and favorably not less than five nor more than 10.

To allow the shaft to have a required strength, it is necessary to make the shaft thick in some extent. Thus if the total number of the prepreg layers is less than three, the thickness of one layer is large. Consequently adjacent prepreg layers are liable to have a difference in level, which may deteriorate the strength of the shaft. On the other hand, if the total number of the prepreg layers is more than 12, operability and productivity are low.

Although the number of plies (number of turns) of each prepreg is not limited to a specific number, it is preferable that the number of plies of each prepreg is not less than one nor more than two. If the number of plies is less than one (one turn), the shaft has a disadvantage in the directionality of flexure. On the other hand, if the number of plies is more than two (two turns), many layers having the same tensile modulus of elasticity are layered on each other, which reduces the effect of the present invention. It is preferable to wind the prepreg at an integral number of times.

It is preferable that the reinforcing fiber of the prepreg of the straight layer is a carbon fiber. By using the carbon fibers as the reinforcing fibers, the shaft of the present invention is allowed to be lightweight and has a high strength.

It is preferable that the reinforcing fibers of an outermost prepreg of the straight layer are pitch-based carbon fibers. The pitch-based carbon fibers and the PAN system carbon fibers are widely used. In the case where the reinforcing fibers of the outermost prepreg of the straight layer are the pitch-based carbon fibers, it is possible to further improve the strength of the shaft.

The ratio of the straight layer, of which the reinforcing fibers are pitch-based carbon fibers, is not less than 5 wt % nor more than 60 wt % and preferably not less than 10 wt % nor more than 40 wt % of all straight layers.

If the ratio is less than 5 wt %, a player has a bad feeling when the player hits a golf ball. On the other hand, if the ratio is more than 60 wt %, it is difficult to design a lightweight shaft, and a shaft is incapable of obtaining a necessary rigidity.

The thickness of one prepreg is set to not less than 0.02 mm nor more than 0.20 mm and favorably not less than 0.05 mm nor more than 0.15 mm.

If the thickness of one prepreg is less than 0.02 mm, it is necessary to wind a larger number of the prepregs on the mandrel and hence a low productivity. On the other hand, If the thickness thereof is more than 0.20 mm, adjacent prepreg layers are liable to have a difference in level, which may deteriorate the strength of the shaft.

It is preferable that the weight of the shaft is not less than 45 g nor more than 60 g.

If the weight of the shaft is less than 45 g, the shaft is so lightweight that it is difficult to control the directionality thereof and the shaft has a low strength. On the other hand, if the weight of the shaft is more than 60 g, the head speed of the shaft does not increase and thus it is difficult to improve a flight distance of a golf ball.

It is preferable that in a hollow pipe-shaped shaft having prepregs layered one upon another, the inner diameter of the shaft at its front end (head-mounting side) is not less than 2 mm nor more than 7 mm and the outer diameter thereof at its front end is not less than 4 mm nor more than 10 mm.

If the inner and outer diameter of the shaft at its front end is less than the lower limit, it is impossible to allow the shaft and the head to contact each other in a sufficient area and obtain a sufficient strength, which causes the shaft to be liable to be broken. On the other hand, if the inner and outer diameter of the shaft at its front end is more than the upper limit, the head and the neck are thick. In this case, a player has difficulty in holding a golf club (player has a feeling of physical disorder).

It is preferable that in the hollow pipe-shaped shaft having prepregs layered one upon another, the inner diameter of the shaft at its rear end (grip-mounted side) is not less than 11 mm nor more than 16 mm and the outer diameter thereof at its rear end is not less than 13 mm nor more than 18 mm.

If the inner and outer diameter of the shaft at its rear end is less than the lower limit, it is impossible to appropriately adjust the weight of the grip and set a grip diameter in such an extent that the grip can be held easily. On the other hand, if the inner and outer diameter of the shaft at its rear end is more than the upper limit, the grip is so thick that a player has difficulty in gripping the grip.

As resin for in the fiber reinforced resin, thermosetting resin and thermoplastic resin can be used. In consideration of strength and rigidity, the thermosetting resin can be preferably used. Above all, epoxy resin is particularly preferable.

The thermosetting resin includes epoxy resin, unsaturated polyester resin(vinyl ester resin), phenol resin, melamine resin, urea resin, diallyl phthalate resin, polyurethane resin, polyimide resin, and silicon resin.

The thermoplastic resin includes polyamide resin, saturated polyester resin, polycarbonate resin, ABS resin, polyvinyl chloride resin, polyacetal resin, polystyrene resin, polyethylene resin, polyvinyl acetate, AS resin, methacrylate resin, polypropylene resin, and fluorine resin.

As reinforcing fibers for use in the fiber reinforced resin, fibers which are used as high-performance reinforcing fibers can be used. In addition to the carbon fiber, for example, it is possible to use graphite fiber, aramid fiber, silicon fiber, alumina fiber, boron fiber, glass fiber, aromatic polyamide fiber, aromatic polyester fiber, ultra-high-molecular-weight polyethylene fiber, and the like. Metal fibers may be used as the reinforcing fiber. The carbon fiber is preferable because it is lightweight and has a high strength. These reinforcing fibers can be used in the form of long or short fibers. A mixture of two or more of these reinforcing fibers may be used. The configuration and arrangement of the reinforcing fibers are not limited to specific ones. For example, they may be arranged in a single direction or a random direction. The reinforcing fibers may have the shape of a sheet, a mat, fabrics (cloth), braids, and the like.

DETAILED DESCRIPTION OF THE PREFERRED EMBODIMENTS

The embodiments of the present invention will be described below with reference to drawings.

Figure 1:
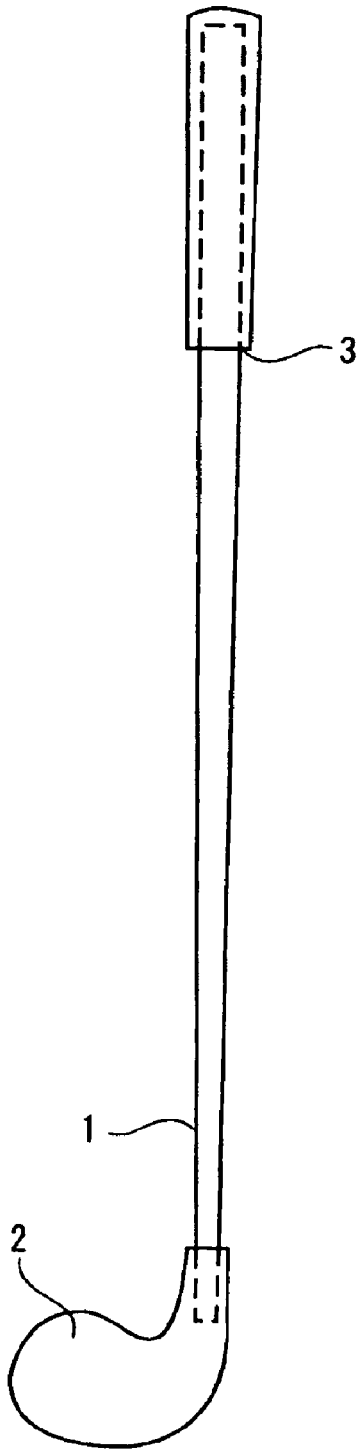
FIG. 1 is a schematic view showing a golf club shaft according to a first embodiment of the present invention.

FIG. 1 shows a golf club shaft (hereinafter referred to as merely shaft) according to a first embodiment of the present invention. A shaft 1 is composed of a laminate of prepregs layered one upon another. A head 2 is installed on the shaft 1 at one end thereof having a smaller diameter. A grip 3 is installed on the shaft 1 at the other end thereof having a larger diameter.

The whole length L of the shaft 1 is 116.8 cm. The weight M of the shaft 1 is 50 g. Thus M/L is about 0.43 g/cm.

Figure 2:
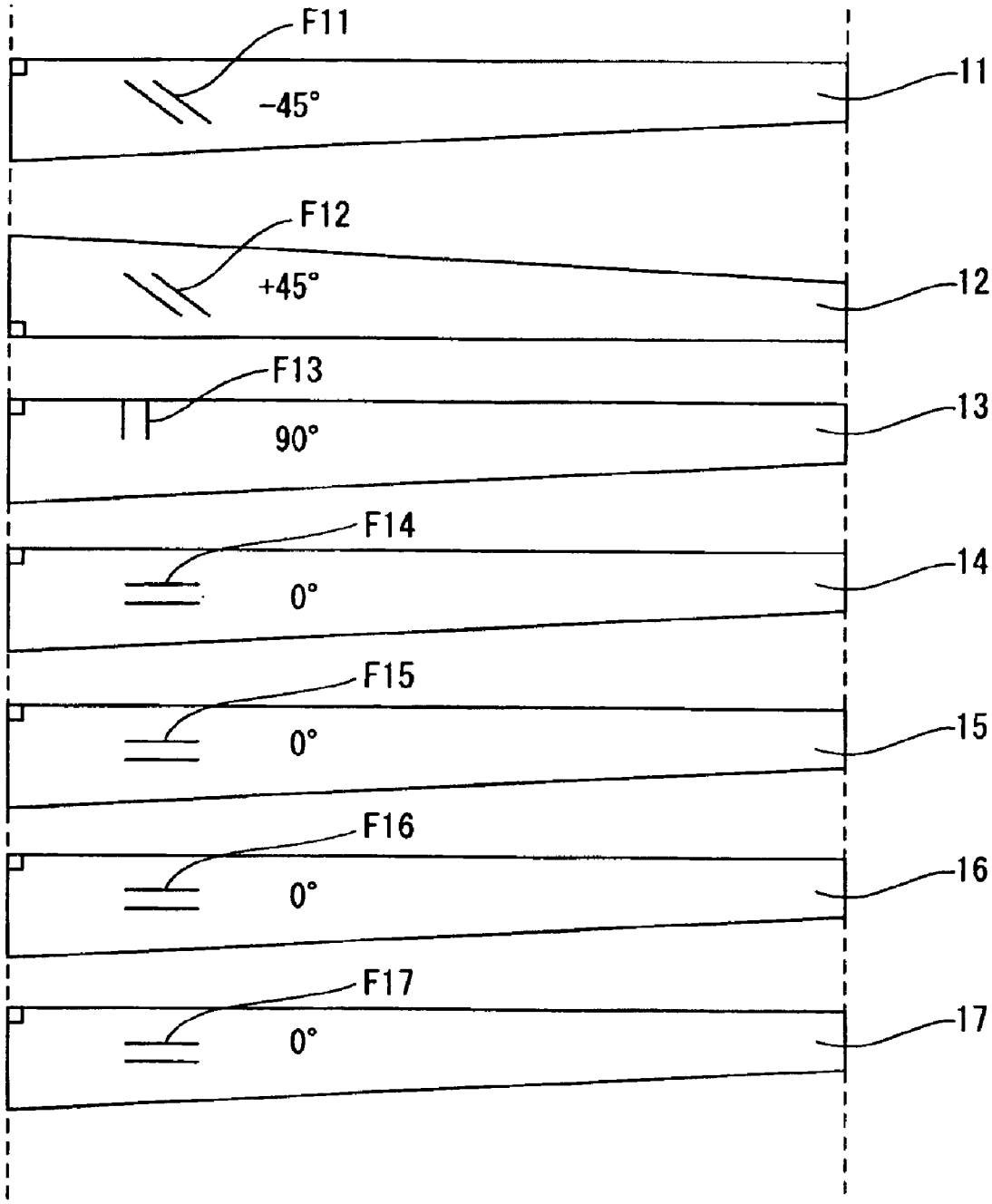
FIG. 2 shows prepregs for use in the golf club shaft of the first embodiment.

In the shaft 1, one ply of each of prepregs 11–17 shown in FIG. 2 is wound on a mandrel (core metal, not shown) in the order from the prepreg 11 to the prepreg 17. Carbon fibers are used as reinforcing fibers F11–F17 of the prepregs 11–17. An epoxy resin is used as the matrix resin.

The construction of the laminate of the prepregs 11–17 is described below.

In the prepregs 11 and 12, the fibrous angles of the reinforcing fibers F11 and F12 with respect to the axis of the shaft 1 are −45° and +45° (angular layer) respectively. The tensile modulus of elasticity of each of the reinforcing fibers F11 and F12 is 40000 kgf/mm$^2$.

In the prepreg 13, the fibrous angle of the reinforcing fiber F13 with respect to the axis of the shaft 1 is 90° (hoop layer). The tensile modulus of elasticity of the reinforcing fiber F13 is 35000 kgf/mm$^2$.

In the prepregs 14 through 17, the fibrous angle of each of the reinforcing fibers F14 through F17 with respect to the axis of the shaft 1 is 0° (straight layer). The tensile moduli of elasticity of the reinforcing fibers F14 through F17 are different from one another, namely, 40000 kgf/mm$^2$, 24000 kgf/mm$^2$, 10000 kgf/mm$^2$, and 5000 kgf/mm$^2$ respectively. That is, the prepregs 14–17 of the straight layer are layered one upon another in such a way that over the whole length of the shaft, the tensile moduli of elasticity of the reinforcing fibers become smaller from the inner side of the straight layer toward the outer side thereof. The weight ratio of the pitch-based carbon fiber to the entire prepreg of the straight layer is 50 wt %.

Figure 3:
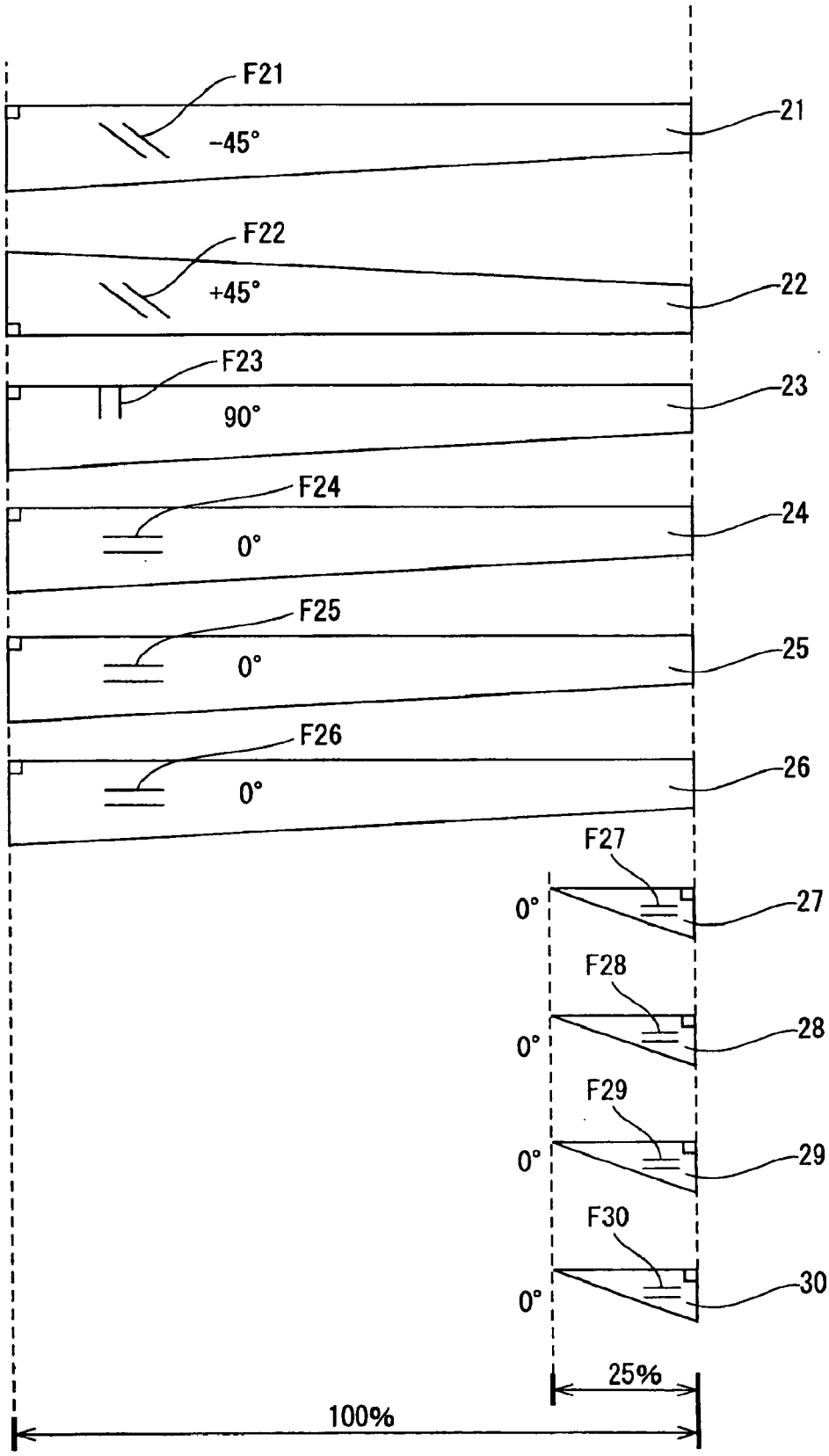
FIG. 3 shows prepregs for use in the golf club shaft of the second embodiment.

The angles shown in FIG. 2 and FIG. 3 fibrous angles of the prepregs respectively. The configurations and widths of the prepregs are as shown in FIG. 2 and FIG. 3. The weight ratio of the prepreg whose reinforcing fiber is pitch-based carbon fiber to the entire prepreg of the straight layer is 50 wt %.

The shaft 1 is formed by sheet winding method as follows: The prepregs 11–17 are layered one upon another by sequentially winding them on the core metal (not shown), a tape made of polyethylene terephthalate is lapped on the laminate. Then integral molding is performed. That is, the tape-lapped laminate is heated in an oven under a pressure to harden the resin. Thereafter the core metal is drawn from the laminate.

As described above, the prepregs 14–17 of the straight layer are layered one upon another in such a way that the tensile moduli of elasticity of the reinforcing fiber become smaller from the inner side of the straight layer toward the outer side thereof. Thus the prepreg of the straight layer becomes more elastic from the outer side thereof toward the inner side thereof, and generation of an interlaminar strain can be reduced. Therefore it is possible to improve the bending strength and durability of the shaft. Further the shaft allows a player to feel a smooth twist when the player swings a golf club and obtain a favorable feeling in hitting a golf ball. That is, the golf club allows the player to obtain a good feeling during the use thereof.

The golf club shaft of the second embodiment of the present invention will be described below with reference to FIG. 3. The construction of the laminate of prepregs 21–30 is described below.

In the prepregs 21 and 22, the fibrous angles of the reinforcing fibers F21 and F22 with respect to the axis of the shaft are −45° and +45° (angular layer) respectively. The tensile modulus of elasticity of each of the reinforcing fibers F21 and F22 is 40000 kgf/mm$^2$.

In the prepreg 23, the fibrous angle of the reinforcing fiber F23 with respect to the axis of the shaft is 90° (hoop layer). The tensile modulus of elasticity of the reinforcing fiber F23 is 35000 kgf/mm$^2$.

In the prepregs 24 through 30, the fibrous angle of each of the reinforcing fibers F24 through F30 with respect to the axis of the shaft is 0° (straight layer). The tensile moduli of elasticity of the reinforcing fibers F24 through F30 are different from one another. More specifically, the tensile modulus of elasticity of the prepreg 24 is 40000 kgf/mm$^2$. The tensile modulus of elasticity of each of the prepregs 25 and 26 is 24000 kgf/mm$^2$. The tensile modulus of elasticity of each of the prepregs 27 and 28 is 10000 kgf/mm$^2$. The tensile modulus of elasticity of each of the prepregs 29 and 30 is 5000 kgf/mm$^2$. The prepregs 21 through 26 are layered over the whole length of the shaft. As a layer for reinforcing the leading end (head-mounting side) of the shaft, the prepregs 27 through 30 are layered in the range 25% of the whole length of the shaft from the tip thereof toward the grip-mounting side thereof. That is, the prepregs 24–30 of the straight layer are layered one upon another in such a way that the tensile moduli of elasticity of the reinforcing fiber become gradually smaller from the inner side of the straight layer toward the outer side thereof. Each of the prepregs 21–30 is wound on a mandrel by one ply. The weight ratio of the pitch-based carbon fiber to the entire prepreg of the straight layer is 50 wt %.

In the first and second embodiments, the tensile moduli of elasticity of the reinforcing fibers of the prepregs of the straight layer are different from one another. However, it is possible to dispose a plurality of prepregs of the straight layer having the same tensile modulus of elasticity one upon another on the mandrel.

The golf club shaft of each of examples 1 through 6 of the present invention and a golf club shaft of each of comparison examples 1 and 2 will be described in detail below.

Using prepregs having the construction described below and carrying out the conventional sheet-winding method, the golf club shaft of each of the examples and the comparison examples was prepared. The layering condition (only the straight layer) of the prepreg of each of the examples and the comparison examples is shown in table 1. The layering condition of the prepreg other than the prepreg of the straight layer was similar to that of the above-described embodiment. In each of the examples and the comparison examples, the weight of the shaft was 50 g, the length of the shaft was 116.8 cm, and weight/length was about 0.43 g/cm. The amount of the prepreg per area, the amount of the carbon fiber per area, and the resin content were appropriately set. As the reinforcing fiber of the prepreg of the straight layer disposed at the outermost layer, the pitch-based carbon fiber was used in the examples 1 through 6 and the PAN system carbon fiber was used in the comparison examples 1 and 2.

TABLE 1

| | E1 | E2 | E3 | E4 | E5 | E6 | CE1 | CE2 |
|---|---|---|---|---|---|---|---|---|
| Tensile modulus of elasticity of the prepreg of the straight layer (kgf/mm$^2$) | | | | | | | | |
| Inner layer | 40000 | 40000 | 40000 | 40000 | 40000 | 24000 | 10000 | 5000 |
| ↓ | 24000 | 24000 | 24000 | 24000 | 24000 | 24000 | 40000 | 10000 |
| ↓ | 10000 | 10000 | 10000 | 24000 | 24000 | 24000 | 5000 | 24000 |
| ↓ | 5000 | 5000 | 5000 | — | — | 5000 | 24000 | 40000 |
| ↓ | — | — | — | 10000 | 10000 | — | — | — |
| ↓ | — | — | — | 10000 | 10000 | — | — | — |
| ↓ | — | — | — | 5000 | 5000 | — | — | — |
| Outer layer | — | — | — | 5000 | 5000 | — | — | — |
| Wt % of pitch-based carbon fiber | 50 | 10 | 40 | 50 | 50 | 5 | 50 | 50 |
| Ratio (%) of length of prepreg of outermost layer to whole length of shaft | 100 | 100 | 100 | 25 | 10 | 100 | 100 | 100 |
| Three-point bending strength (Average (N)) | 960 | 880 | 900 | 850 | 830 | 800 | 770 | 720 |
| Durability test | 9000 | 8500 | 8700 | 8400 | 8400 | 8100 | 7500 | 7000 |
| Feeling evaluation | | | | | | | | |
| During swinging | 5 | 5 | 5 | 5 | 4 | 4 | 3 | 2 |
| Ball-hitting feeling | 5 | 5 | 5 | 5 | 4 | 4 | 2 | 2 |

where E denotes example of the present invention, and CE denotes comparison example.

EXAMPLE 1

The layering construction of the prepreg was similar to that of the above-described first embodiment.

EXAMPLE 2

The weight ratio of the prepreg whose reinforcing fiber was pitch-based carbon fiber to the entire prepreg of the straight layer was set to 10 wt %. The other specifications was similar to that of the example 1.

EXAMPLE 3

The weight ratio of the prepreg whose reinforcing fiber was pitch-based carbon fiber to the entire prepreg of the straight layer was set to 40 wt %. The other specifications was similar to that of the example 1.

EXAMPLE 4

The layering construction of the prepreg was similar to that of the above-described second embodiment.

EXAMPLE 5

Four prepregs for reinforcing the head-mounting side of the shaft were layered one upon another in a region 10% of the whole length of the shaft from its tip toward the grip-mounting side thereof. The other specifications was similar to that of the example 4.

EXAMPLE 6

The tensile moduli of elasticity of the prepregs of the straight layer were set to 24000 kgf/mm$^2$, 24000 kgf/mm$^2$, 24000 kgf/mm$^2$, and 5000 kgf/mm$^2$ respectively from the inner layer of the straight layer to the outer layer thereof. The weight ratio of the prepreg whose reinforcing fiber is pitch-based carbon fiber to the entire prepreg of the straight layer is 5 wt %. The other specifications was similar to that of the example 1.

COMPARISON EXAMPLE 1

The tensile moduli of elasticity of the prepregs of the straight layer were set to 10000 kgf/mm$^2$, 40000 kgf/mm$^2$, 5000 kgf/mm$^2$, and 24000 kgf/mm$^2$ respectively from the inner layer of the straight layer to the outer layer thereof. The other specifications was similar to that of the example 1.

COMPARISON EXAMPLE 2

The tensile moduli of elasticity of the prepregs of the straight layer were set to 5000 kgf/mm$^2$, 10000 kgf/mm$^2$, 24000 kgf/mm$^2$, and 40000 kgf/mm$^2$ respectively from the inner layer of the straight layer to the outer layer thereof. The other specifications were similar to that of the example 1.

A test for examining a three-point bending strength, a durability test, and a feeling evaluation were conducted on the golf club shaft of each of the examples 1 through 6 and the golf club shaft of each of the comparison examples 1 and 2 by using a method described later. The results of the tests are shown in table 1.

Three-Point Bending Strength Test

Figure 4:
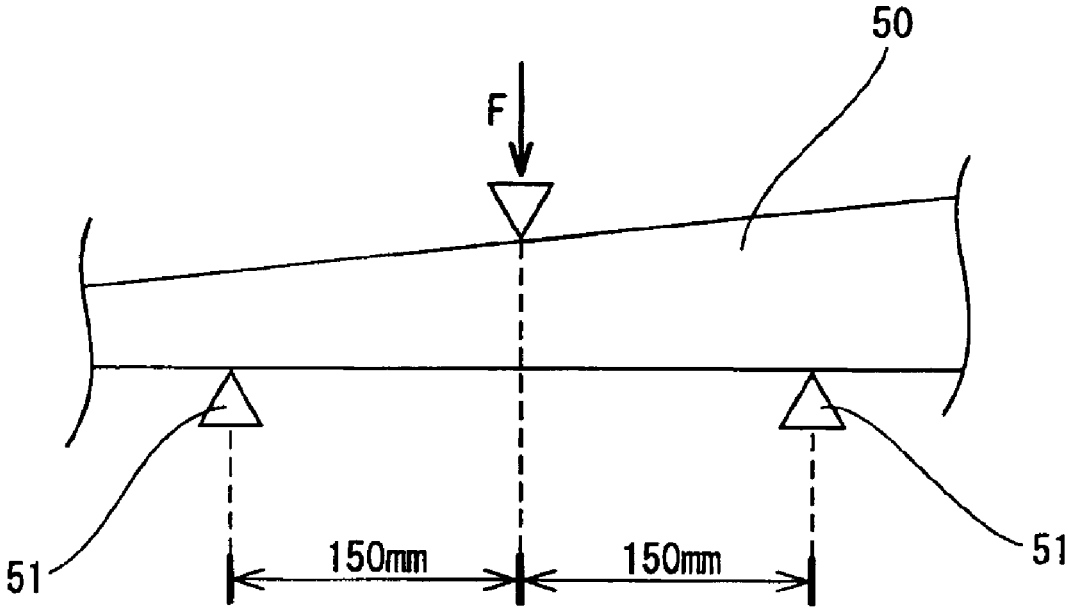
FIG. 4 shows a three-point bending strength testing method.

The three-point bending strength means a breaking strength of SG method provided by Product Safety Association. As shown in FIG. 4, a load F is applied from above to a shaft 50 supported at three points. The value (peak value) of the load when the shaft 50 was broken was measured. The bending strength was measured at points T, A, and B which were 90 mm, 175 mm, and 525 mm apart from the smallest-diameter side of the shaft, respectively and a point C 175 mm apart from the largest-diameter side of the shaft. The span between supporting points 51 was 150 mm only when the bending strength was measured at the point T and 300 mm when the bending strength was measured at the points A, B, and C. The bending strength was measured by supporting the shaft 50, with the position (position of 0° in circumferential direction of shaft) of the boundary (connection portion) of the prepreg of the angular layer (layer bisected and inclining in opposite directions) upward. Further the bending strength was measured by supporting the shaft 50 with the shaft rotated by 90° on its axis and with the position (position of 0° in circumferential direction of shaft) of the boundary (connection portion) of the prepreg of the angular layer horizontal. The average value of each of the points T, A, B, and C are shown in table 1.

Durability Test

Using a swing machine (head speed: 48 m/s), heel (a point disposed between the face center and the neck and 20 mm apart from the face center) hitting was carried out. The number of hitting times before the shaft was broken was counted for evaluation. A two-piece ball commercially available was hit with a driver head of loft 12°.

Feeling Evaluation

The evaluation was made on "during swinging" and "feeling in hitting a golf ball" in five grades of marks 1 (worst) through 5 (excellent).

As shown in table 1, the golf club shafts of the examples 1 through 6 had 800N–960N in the three-point bending strength. It was confirmed that they had a sufficient strength. On the other hand, the golf club shafts of the comparison examples 1 and 2 had 720N–770N in the three-point bending strength, they were inferior to the golf club shafts of the examples. In the durability test, the golf club shafts of the examples 1 through 6 were not broken until they hit golf balls at 8100–9000 times. It was also confirmed that they were excellent in durability. On the other hand, the golf club shafts of the comparison examples 1 and 2 were broken at 7000–7500 times, they were inferior to the golf club shafts of the examples in durability. In the feeling evaluation, the golf club shafts of the examples 1 through 6 had "5" and "4". On the other hand, the golf club shafts of the comparison examples 1 and 2 had "3" and "2", they were inferior to the golf club shafts of the examples in the feeling evaluation.

As apparent from the foregoing description, according to the present invention, in the straight layer which affects the bending strength of the shaft greatly, it is possible to improve the bending strength and durability of the shaft and player's feeling in hitting a golf ball by setting the tensile modulus of elasticity of the reinforcing fiber of the outer prepreg layer of the straight layer smaller than that of the reinforcing fiber of the inner prepreg layer thereof.

The construction of the shaft of the present invention improves the strength of the shaft. Thus the shaft of the present invention is effectively applicable to a lightweight shaft which is thin and has an insufficient strength. Thus it is possible to make the shaft more lightweight. Thereby the golf club shaft made of a fiber reinforced resin is capable of having an improved strength without increasing its weight and allows a player to have a favorable feeling in hitting a golf ball.

What is claimed is:

1. A golf club shaft, composed of a laminate of prepregs made of a fiber reinforced resin, wherein a weight of a unit length of said golf club shaft in an axial direction thereof is set to not less than 0.25 g/cm nor more than 0.60 g/cm; and if tensile moduli of elasticity of all of said reinforcing fibers of said prepregs of a straight layer, which are parallel with said axial direction of said golf club shaft, are sequentially denoted by N1, N2, . . . Nn in the order from an innermost layer of said laminate to an outermost layer thereof, then $N1 \geqq N2 \geqq Nn$ and $N1 > Nn$ is established in a range at least 10% of a whole length of said golf club shaft, wherein n is an integer not less than 3, and wherein at least three different prepreg layers each having different moduli of elasticity are present of said prepregs which form a straight layer with fibers parallel with said axial direction of said golf club shaft.

2. The golf club shaft according to claim 1, having 3–8 straight layers of which said tensile moduli of elasticity of said reinforcing fibers are different from each other.

3. The golf club shaft according to claim 1, wherein said reinforcing fibers of said prepreg of said straight layer are carbon fibers.

4. The golf club shaft according to claim 1, wherein said reinforcing fibers of said outermost prepreg of said straight layer are pitch-based carbon fibers.

5. The golf club shaft according to claim 1, wherein a ratio of said straight layer, of which said reinforcing fibers are pitch-based carbon fibers, is not less than 5 wt % nor more than 60 wt % of all straight layers.

6. The golf club shaft according to claim 1, wherein $N1 \geqq N2 \geqq \ldots Nn$ and $N1 > Nn$ is established in a range at least 25% of said whole length of said golf club shaft.

7. The golf club shaft according to claim 1, wherein said $N1 \geqq N2 \geqq \ldots Nn$ and $N1 > Nn$ is established in a range not less than 50% nor more than 100% of said whole length of said golf club shaft.

8. The golf club shaft according to claim 1, wherein said tensile moduli of elasticity of said reinforcing fibers of said prepregs of said straight layer are different from one another; and a difference between said tensile moduli of elasticity of said reinforcing fibers of said adjacent prepregs of said straight layer is not less than 2000 kgf/mm$^2$ nor more than 30000 kgf/mm$^2$.

9. The golf club shaft according to claim 1, wherein a total number of said prepreg layers is not less than three nor more than twelve.

10. The golf club shaft according to claim 1, wherein the number of plies of said each prepreg is not less than one nor more than two.

11. A golf club shaft, composed of a laminate of prepregs made of a fiber reinforced resin, wherein a weight of a unit length of said golf club shaft in an axial direction thereof is set to not less than 0.25 g/cm nor more than 0.60 g/cm; and if tensile moduli of elasticity of all of said reinforcing fibers of said prepregs of a straight layer, which are parallel with said axial direction of said golf club shaft, are sequentially denoted by N1, N2, . . . Nn in the order from an innermost layer of said laminate to an outermost layer thereof, then $N1 \geqq N2 \geqq Nn$ and $N1 > Nn$ is established in a range at least 10% of a whole length of said golf club shaft, wherein n is an integer not less than 3, wherein a tensile modulus of elasticity of a reinforcing fiber of an outermost prepreg of said straight layer is not less than 5000 kgf/mm$^2$ nor more than 30000 kgf/mm$^2$, and wherein at least three different prepreg layers each having different moduli of elasticity are present of said prepregs which form a straight layer with fibers parallel with said axial direction of said golf club shaft.

12. The golf club shaft according to claim 11, having 3–8 straight layers of which said tensile moduli of elasticity of said reinforcing fibers are different from each other.

13. The golf club shaft according to claim 11, wherein said reinforcing fibers of said prepreg of said straight layer are carbon fibers.

14. The golf club shaft according to claim 11, wherein said reinforcing fibers of said outermost prepreg of said straight layer are pitch-based carbon fibers.

15. The golf club shaft according to claim 11, wherein a ratio of said straight layer, of which said reinforcing fibers are pitch-based carbon fibers, is not less than 5 wt % nor more than 60 wt % of all straight layers.

16. The golf club shaft according to claim 11, wherein $N1 \geqq N2 \geqq \ldots Nn$ and $N1 > Nn$ is established in a range at least 25% of said whole length of said golf club shaft.

17. The golf club shaft according to claim 11, wherein said $N1 \geqq N2 \geqq \ldots Nn$ and $N1 > Nn$ is established in a range not less than 50% nor more than 100% of said whole length of said golf club shaft.

18. The golf club shaft according to claim 11, wherein said tensile moduli of elasticity of said reinforcing fibers of said prepregs of said straight layer are different from one another; and a difference between said tensile moduli of elasticity of said reinforcing fibers of said adjacent prepregs of said straight layer is not less than 2000 kgf/mm$^2$ nor more than 30000 kgf/mm$^2$.

19. The golf club shaft according to claim 11, wherein a total number of said prepreg layers is not less than three nor more than twelve.

20. The golf club shaft according to claim 11, wherein the number of plies of said each prepreg is not less than one nor more than two.

* * * * *